US006253496B1

(12) United States Patent
Gilchrist

(10) Patent No.: US 6,253,496 B1
(45) Date of Patent: Jul. 3, 2001

(54) TEMPORARY GUTTER RETAINER

(76) Inventor: John D. Gilchrist, N1045 County Trunk Hwy. KW, Cedar Grove, WI (US) 53013

( * ) Notice: Subject to any disclaimer, the term of this patent is extended or adjusted under 35 U.S.C. 154(b) by 0 days.

(21) Appl. No.: 09/504,027

(22) Filed: Feb. 18, 2000

(51) Int. Cl.[7] ..... E04D 13/064

(52) U.S. Cl. ..... 52/12; 52/11; 52/741; 52/712; 52/714; 248/48.2; 248/48.1; 248/222.3; 248/222.4; 269/55; 269/74; 269/79; 269/81; 269/307

(58) Field of Search ..... 52/11, 12, 741, 52/712, 714; 269/55, 74, 79, 81, 307; 248/48.2, 48.1, 222.3, 222.4

(56) References Cited

U.S. PATENT DOCUMENTS

| | | | | |
|---|---|---|---|---|
| 2,147,799 | * | 2/1939 | Reynolds | 248/48.2 |
| 2,686,960 | | 8/1954 | LeRoy | 29/285 |
| 4,579,303 | * | 4/1986 | Midlik | 248/48.2 |
| 5,240,234 | | 8/1993 | Lee | 269/43 |
| 5,522,149 | * | 6/1996 | Meyer | 33/646 |
| 5,873,568 | * | 2/1999 | Mayfield | 269/41 |

* cited by examiner

*Primary Examiner*—Carl D. Friedman
*Assistant Examiner*—Christy M. Syres
(74) *Attorney, Agent, or Firm*—Donald J. Ersler

(57) ABSTRACT

A temporary gutter retainer includes an attachment member, support member, and lateral containment member. A bottom gusset is preferably formed behind the attachment member, support member, and lateral containment member. A top gusset is preferably formed above the junction between the attachment member and support member. At least two holes are formed through the attachment member. Each of the holes are sized to provide clearance for a suitable screw. The temporary gutter retainer is preferably used in the following manner. A first temporary gutter retainer is attached near one end of a facia board and a second temporary gutter retainer is attached near the other end of the facia board with screws and a portable power tool. The installer places the gutter segment into the first and second temporary gutter retainers. A level is placed inside the gutter segment at one of the ends thereof; the gutter segment is raised or lowered to the correct height; and the gutter segment is then attached to the facia board. The above process is repeated along the length of the gutter segment until the whole gutter segment is attached to the facia board. The temporary gutter retainers are then removed from the facia board.

6 Claims, 8 Drawing Sheets

TEMPORARY GUTTER RETAINER

BACKGROUND OF THE INVENTION

1. Field of the Invention

The present invention relates generally to hanging gutters and more specifically to a temporary gutter retainer which allows a gutter to be positioned before it is permanently secured.

2. Discussion of the Prior Art

Currently, there appears to be no device on the market which allows a gutter to be hung by one installer. There have been several attempts to provide a device which allows one installer to hang a gutter. However, these devices have at least one drawback in construction or use. U.S. Pat. No. 5,240,234 to Lee and U.S. Pat. No. 2,686,960 to LeRoy disclose devices for positioning a gutter on a facia board. The drawback to these devices is there requirement of inserting an element of the invention behind a facia board. In some cases, there is no gap behind the facia board to insert an object. U.S. Pat. No. 4,579,303 to Midlik and U.S. Pat. No. 2,147,799 to Reynolds disclose devices for positioning a gutter on a facia board and overhang, respectively. Unfortunately, both devices are either complicated in construction or use.

Accordingly, there is a clearly felt need in the art for a temporary gutter retainer which allows one installer to position a gutter for hanging in a efficient and uncomplicated fashion.

SUMMARY OF THE INVENTION

The present invention allows one installer to position a gutter for hanging. According to the present invention, a temporary gutter retainer includes an attachment member, support member, and lateral containment member. A bottom gusset is preferably formed behind the attachment member, support member, and lateral containment member. A top gusset is preferably formed above the junction between the attachment member and support member. At least two holes are formed through the attachment member. Each of the holes are sized to provide clearance for a suitable screw. The temporary gutter retainer is preferably fabricated from a single piece of plastic material.

The temporary gutter retainer is preferably used in the following manner. A first temporary gutter retainer is attached near one end of a facia board and a second temporary gutter retainer is also attached near the other end of the facia board with screws and a portable power tool. The installer places the gutter segment into the first and second temporary gutter retainers. A level is placed inside the gutter segment at one of the ends thereof; the gutter segment is raised or lowered to the correct height; and the gutter segment is then attached to the facia board. The above process is repeated along the length of the gutter segment until the whole gutter segment is attached to the facia board. The temporary gutter retainers are then removed from the facia board.

Accordingly, it is an object of the present invention to provide a temporary gutter retainer which allows one installer to hang a gutter segment.

These and additional objects, advantages, features and benefits of the present invention will become apparent from the following specification.

DETAILED DESCRIPTION OF THE PREFERRED EMBODIMENTS

Figure 1:
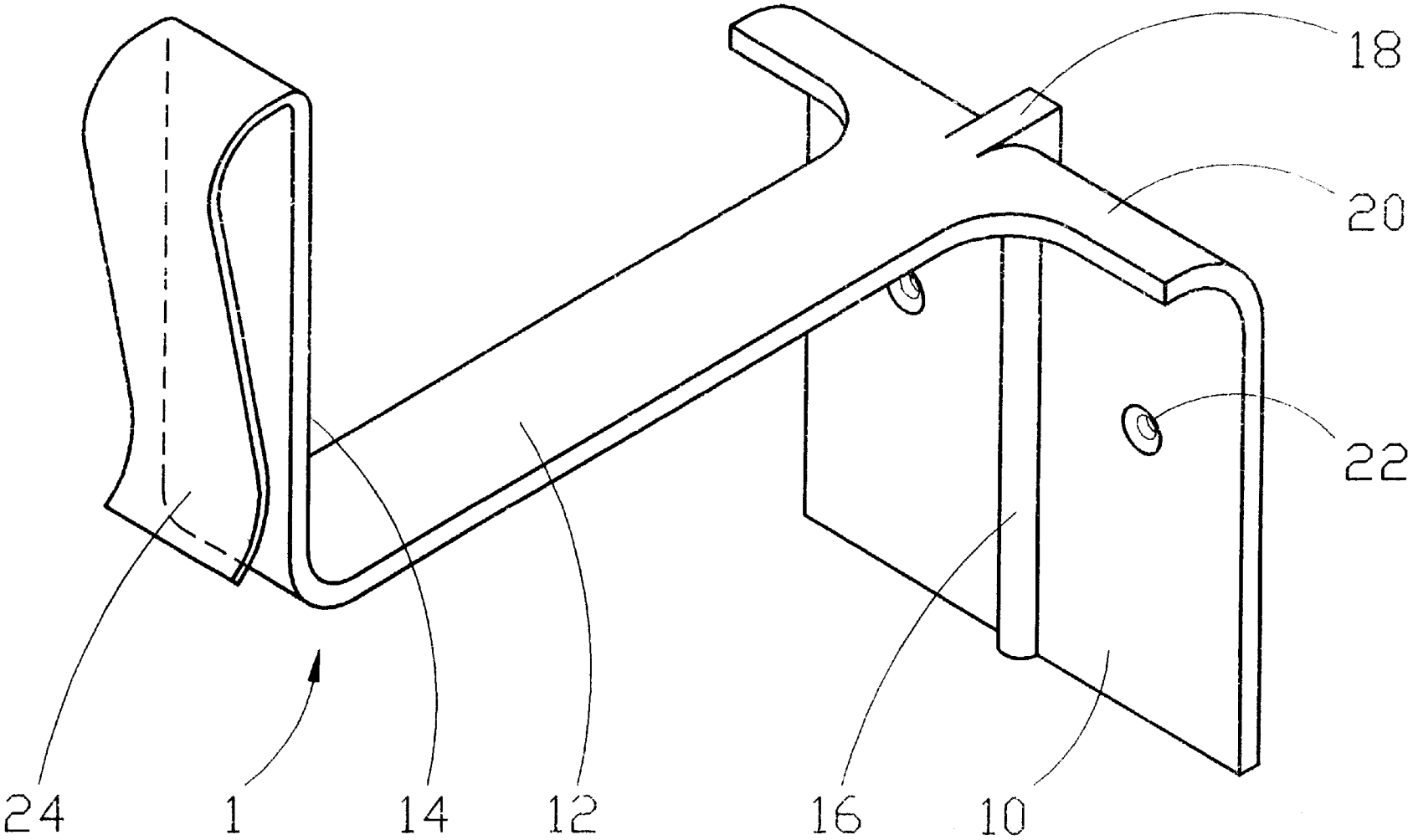
FIG. 1 is a perspective view of a temporary gutter retainer in accordance with the present invention.
Figure 2:
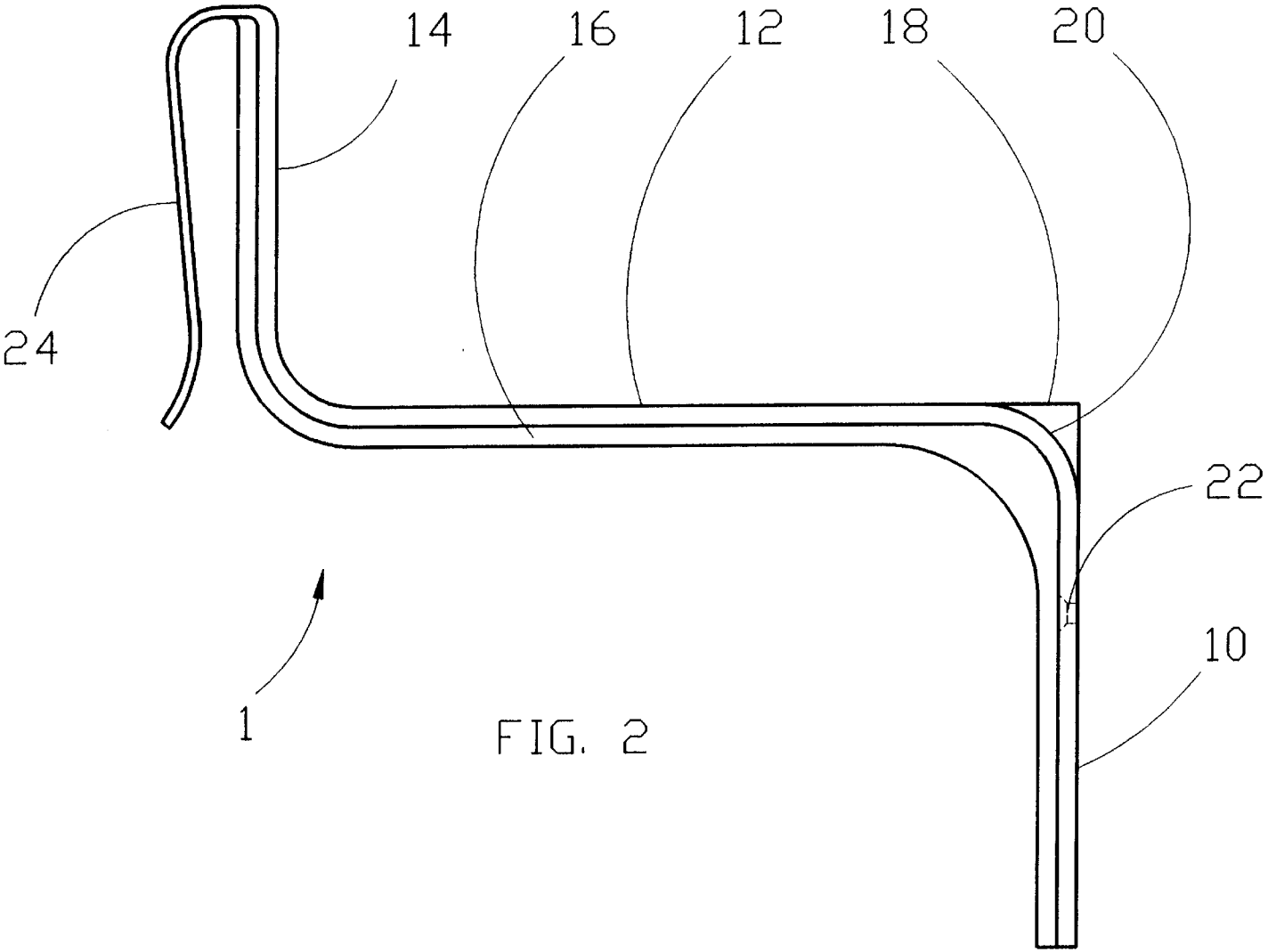
FIG. 2 is a side view of a temporary gutter retainer in accordance with the present invention.
Figure 2A:
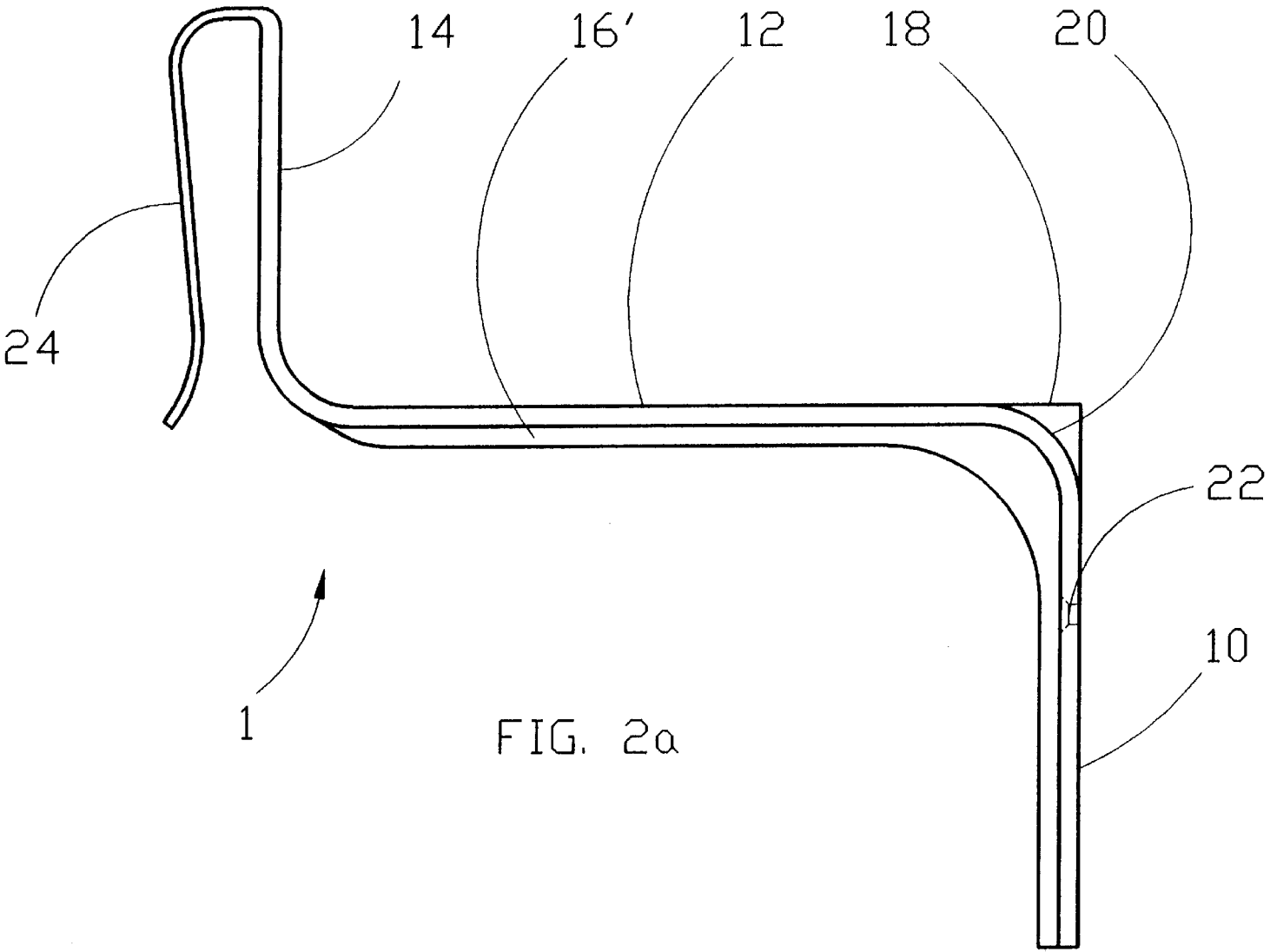
FIG. 2*a* is a side view of a temporary gutter retainer with a bottom gusset behind the attachment member and support member in accordance with the present invention.
Figure 4:
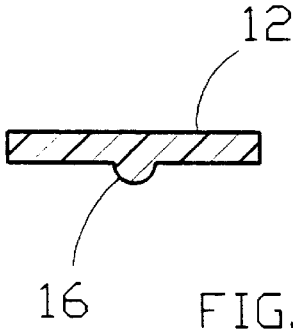
FIG. 4 is a cross-sectional view of a support member of a temporary gutter retainer in accordance with the present invention.
Figure 3:
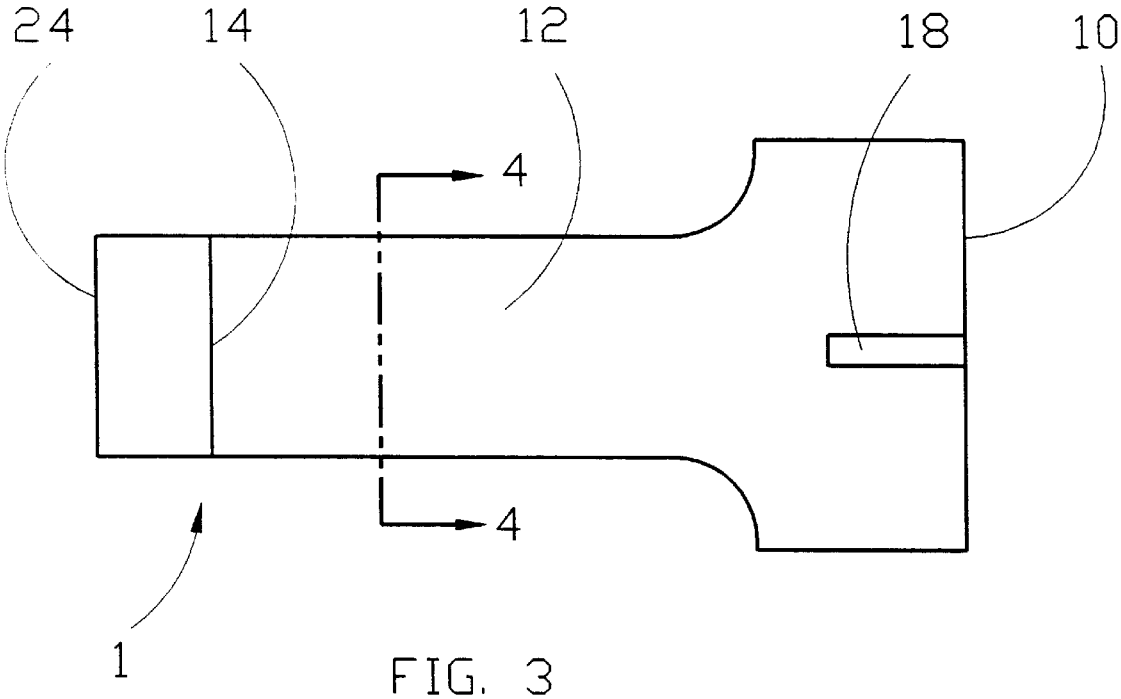
FIG. 3 is a top view of a temporary gutter retainer in accordance with the present invention.
Figure 5:
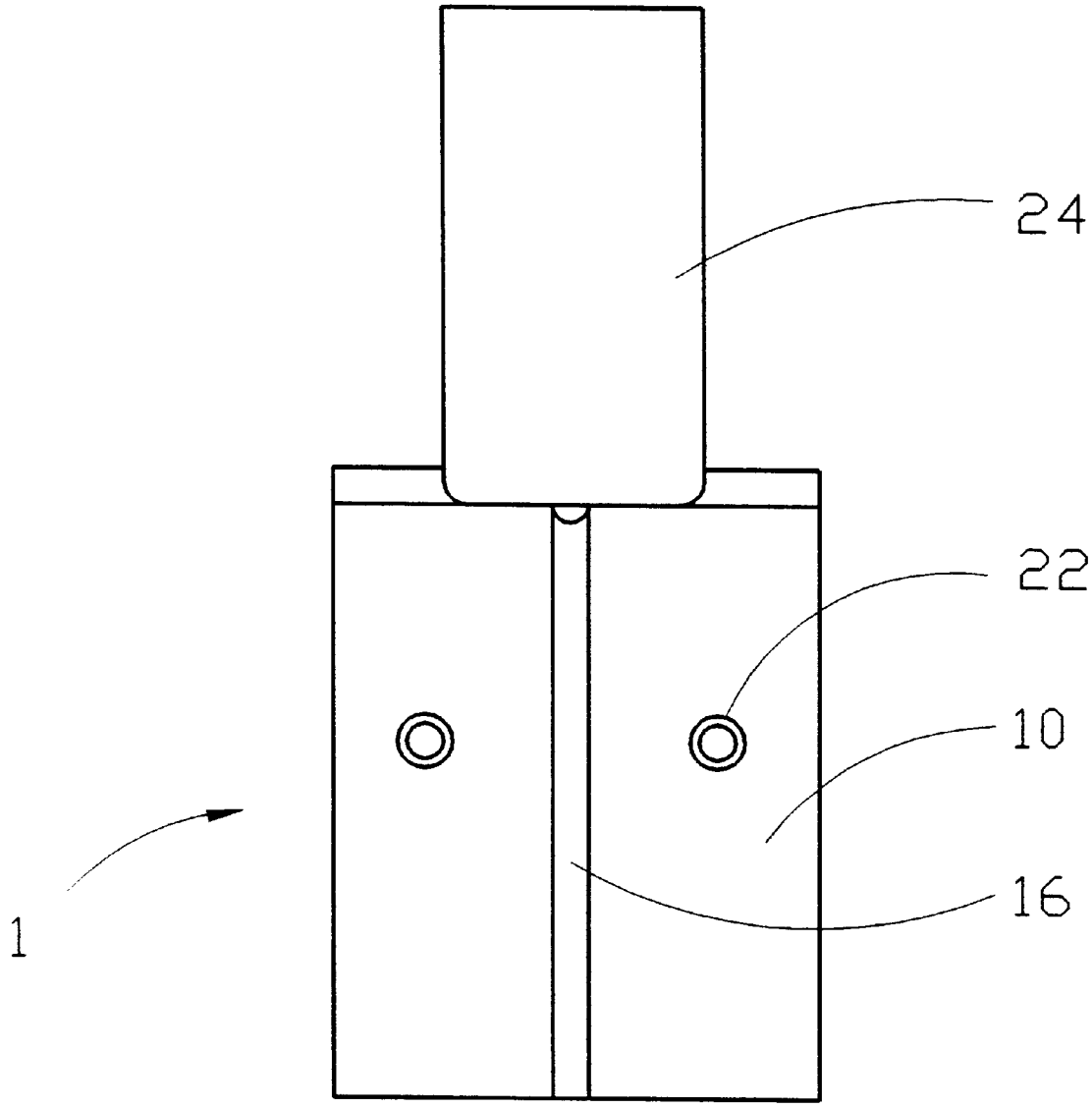
FIG. 5 is a front end view of a temporary gutter retainer in accordance with the present invention.

With reference now to the drawings, and particularly to FIG. 1, there is shown a perspective view of a temporary gutter retainer 1. With reference to FIGS. 2–5, the temporary gutter retainer 1 includes an attachment member 10, support member 12, and lateral containment member 14. A bottom gusset 16 is preferably formed behind the attachment member 10, support member 12, and lateral containment member 14. The bottom gusset 16' could also be formed under the attachment member 10 and the support member 12 as shown in FIG. 2*a*. FIG. 4 shows a cross section of the support member 12 with the gusset 16 or 16'. A top gusset 18 is preferably formed above the junction 20 between the attachment member 10 and support member 12. The top and bottom gussets strengthen the temporary gutter retainer 1 so that the thickness and width of the support member 12 and the thickness of the attachment member 10 may be reduced.

Figure 6:
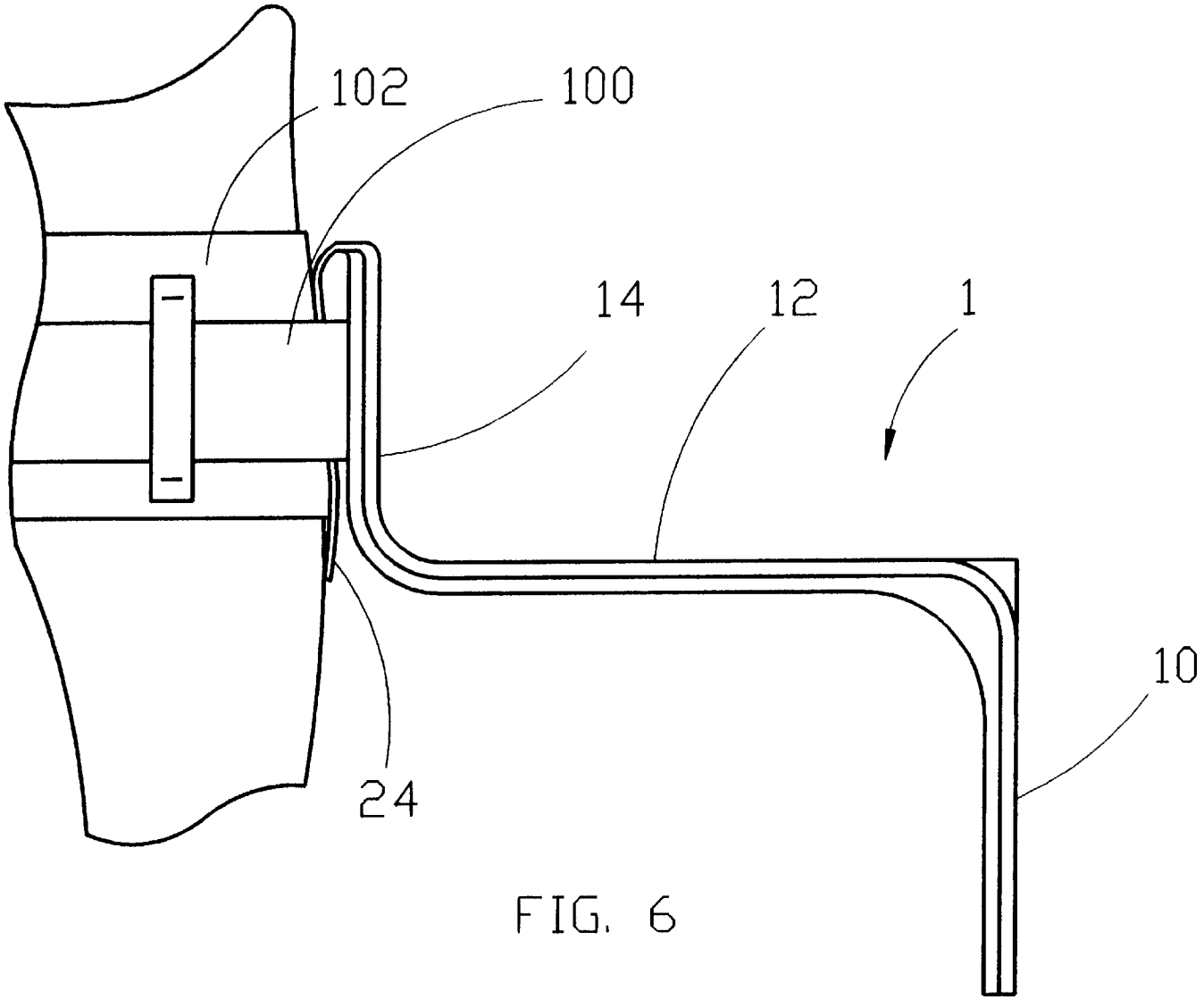
FIG. 6 is a front view of a temporary gutter retainer being retain by a trouser belt on the side of an installer in accordance with the present invention.

At least two holes 22 are formed through the attachment member 10. Each of the holes 22 are sized to provide clearance for a suitable screw. The temporary gutter retainer is preferably fabricated from a single piece of plastic material such as polypropylene. A clip portion 24 preferably extends downward from a top of the lateral containment member 14. With reference to FIG. 6, the clip portion 24 may be used to attach thereof to an installer's trouser belt 100. The clip portion 24 is inserted between the trouser belt 100 and the trouser 102.

Figure 7:
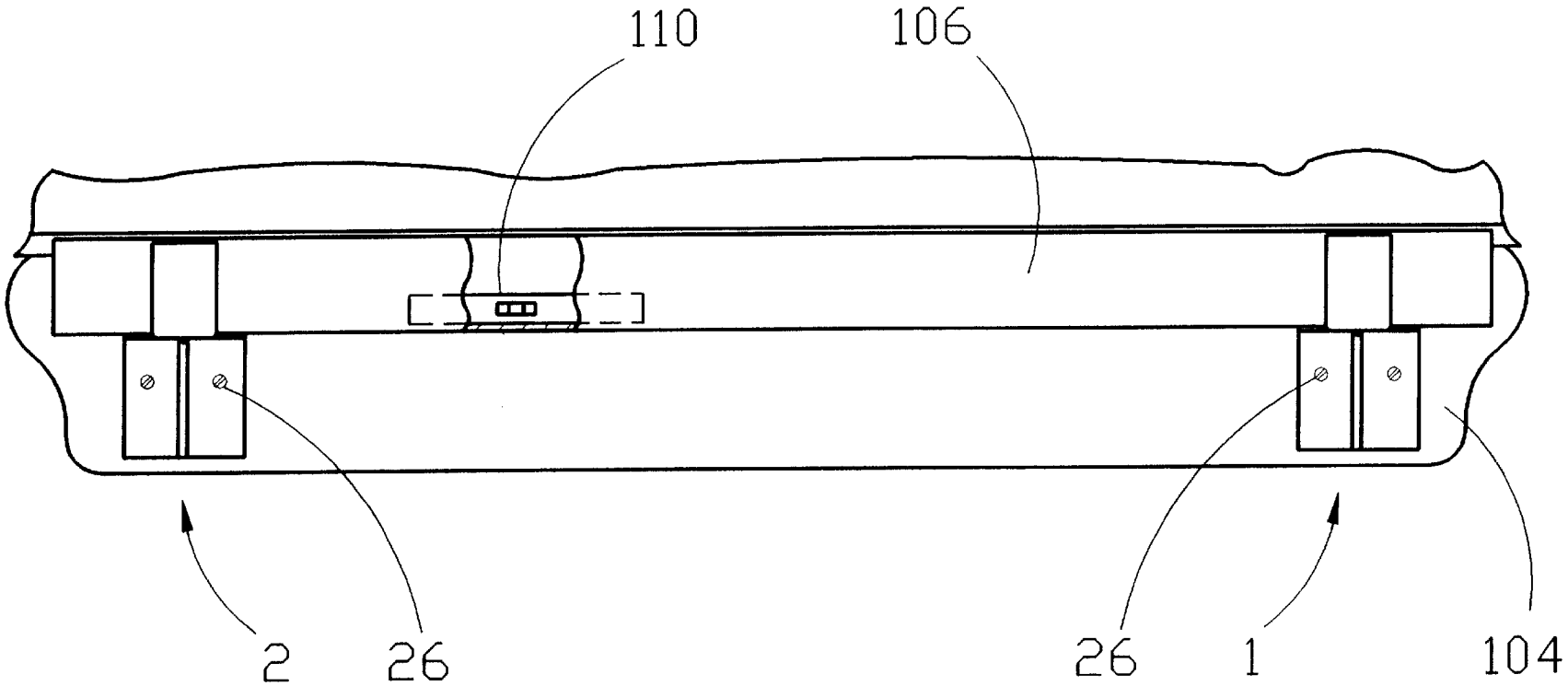
FIG. 7 is a front view of a gutter segment being installed utilizing two temporary gutter retainers in accordance with the present invention.
Figure 8:
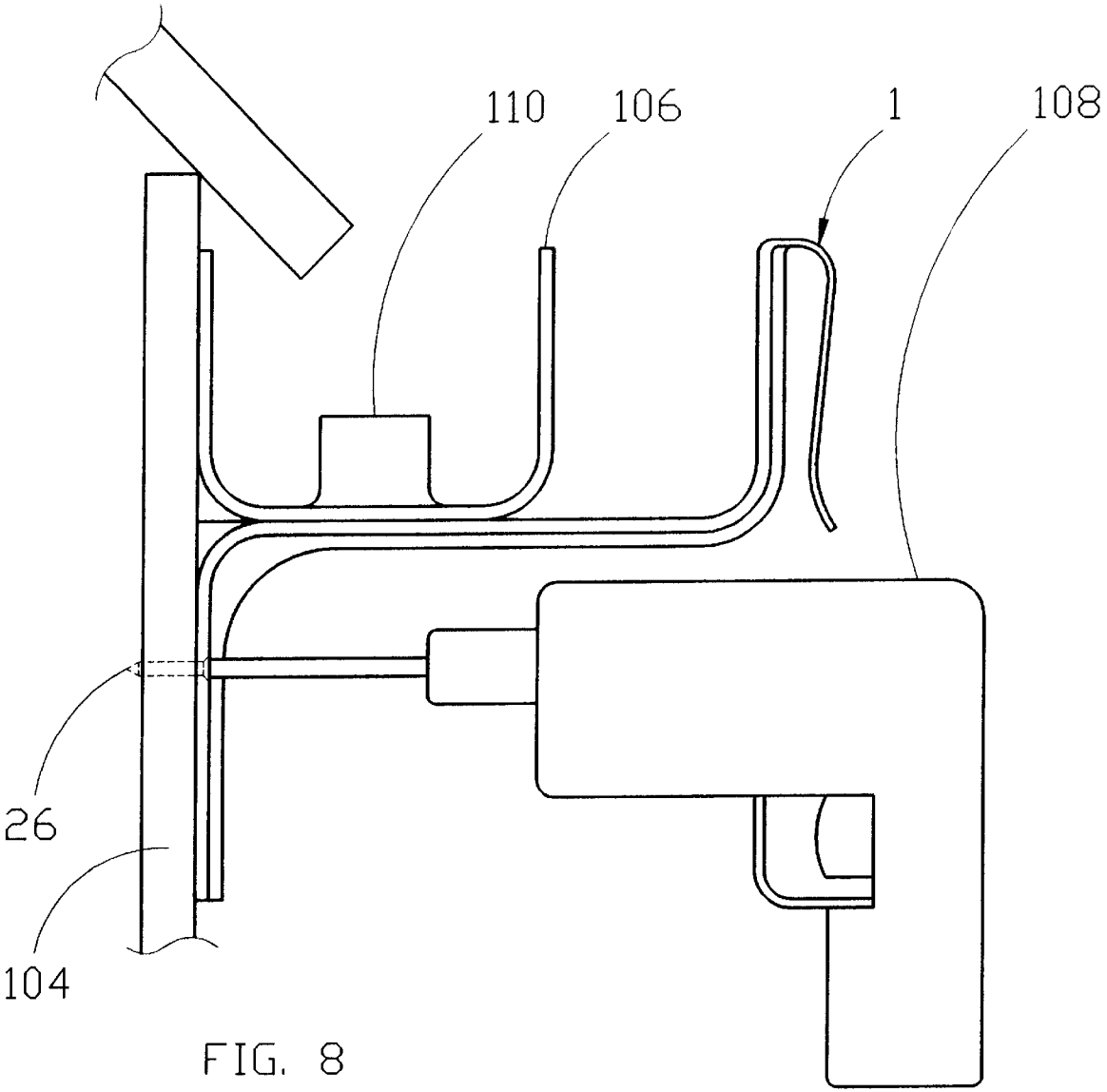
FIG. 8 is an end view of a gutter segment being installed utilizing a temporary gutter retainer and power hand tool in accordance with the present invention.

With reference to FIGS. 7 and 8, the temporary gutter retainer 1 is preferably used in the following manner. A first temporary gutter retainer 1 is attached near one end of a facia board 104 and a second temporary gutter retainer 2 is also attached near the other end of the facia board 104 with screws 26 and a portable power tool 108. The installer places the gutter segment 106 into the first and second temporary gutter retainers. A level 110 is placed inside the gutter segment 106 at one of the ends thereof; the gutter segment 106 is raised or lowered to the correct height; and the gutter segment 106 is then attached to the facia board 104 with fasteners and/or gutter clips. The installer then moves along the gutter segment 106 with the level 110 every four to six feet; raises or lowers the gutter segment 106 to the correct height; and attaches the gutter segment 106 to the facia board 104. The above process is repeated until the whole gutter segment is attached to the facia board. The first and second temporary gutter retainers are then removed from the facia board.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A temporary gutter retainer comprising:

an attachment member having at least two holes formed therethrough;

a support member extending from a top of said attachment member;

a lateral containment member extending upward from an end of said support member;

a bottom gusset being formed on said attachment member and said support member; and a clip portion extending downward from a top of said lateral containment member, said clip portion being capable of attaching to a trouser belt.

2. The temporary gutter retainer of claim 1, further comprising:

a top gusset being formed above a junction between said attachment member and said support member.

3. The temporary gutter retainer of claim 1, wherein:

said bottom gusset being formed on said lateral containment member.

4. The temporary gutter retainer of claim 1, further comprising:

said temporary gutter retainer being fabricated from a single piece of plastic material.

5. A temporary gutter retainer comprising:

an attachment member having at least two holes formed therethrough;

a support member extending from a top of said attachment member;

a lateral containment member extending upward from an end of said support member;

a bottom gusset being formed on said attachment member, said support member, and said lateral containment member;

a top gusset being formed above a junction between said attachment member and said support member; and a clip portion extending downward from a top of said lateral containment member, said clip portion being capable of attaching to a trouser belt.

6. The temporary gutter retainer of claim 5, further comprising:

said temporary gutter retainer being fabricated from a single piece of plastic material.

* * * * *